United States Patent [19]

Uhlig

[11] Patent Number: 4,533,058

[45] Date of Patent: Aug. 6, 1985

[54] ONE-PIECE THERMOPLASTIC CHILD-RESISTENT DISPENSING CLOSURE

[75] Inventor: Albert P. Uhlig, Toledo, Ohio

[73] Assignee: Owens-Illinois, Inc., Toledo, Ohio

[21] Appl. No.: 676,029

[22] Filed: Nov. 28, 1984

[51] Int. Cl.[3] ..... B65D 55/02

[52] U.S. Cl. ..... 215/216; 215/211; 215/301; 215/237; 215/235; 222/153

[58] Field of Search ..... 215/216, 211, 235, 237, 215/301; 220/281; 222/153, 556

[56] References Cited

U.S. PATENT DOCUMENTS

| | | | |
|---|---|---|---|
| Re. 29,793 | 10/1978 | Pehr | 222/153 |
| 4,022,352 | 5/1977 | Pehr | 222/153 |
| 4,209,100 | 6/1980 | Uhlig | 215/237 |
| 4,220,262 | 9/1980 | Uhlig et al. | 215/301 |

*Primary Examiner*—George T. Hall
*Attorney, Agent, or Firm*—John R. Nelson

[57] ABSTRACT

A one-piece molded thermoplastic child-resistent dispensing closure in which the dispensing opening in the closure is sealed by the downwardly extending projection of a locking flap that is foldably attached to an edge of the closure, in which the top of the closure comprises a recess to receive the sealing flap when it is in its closing position and in which the portion of the recess which is adjacent the free end of the locking flap is deeper than the thickness of the locking flap so that the free end of the locking flap can be depressed within the recess to facilitate the opening of the closure. Certain embodiments are described in which the locking flap is provided with a downwardly depending tab which is received in a recess in the skirt of the closure when the locking flap is in the closed position and which is deflected outwardly from the recess by the depression of the locking flap into the recess in the top of the closure to further facilitate the opening of the closure.

14 Claims, 27 Drawing Figures

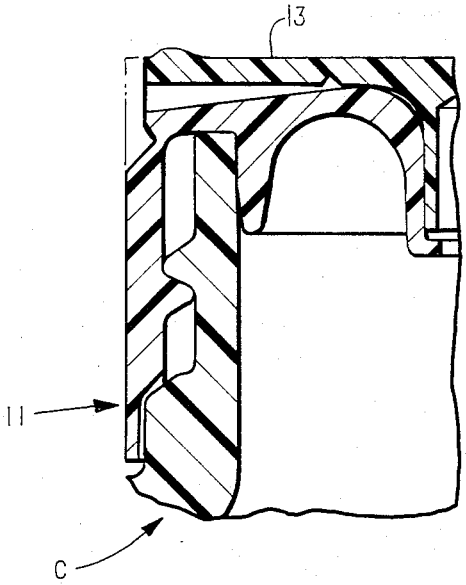
FIG. 18
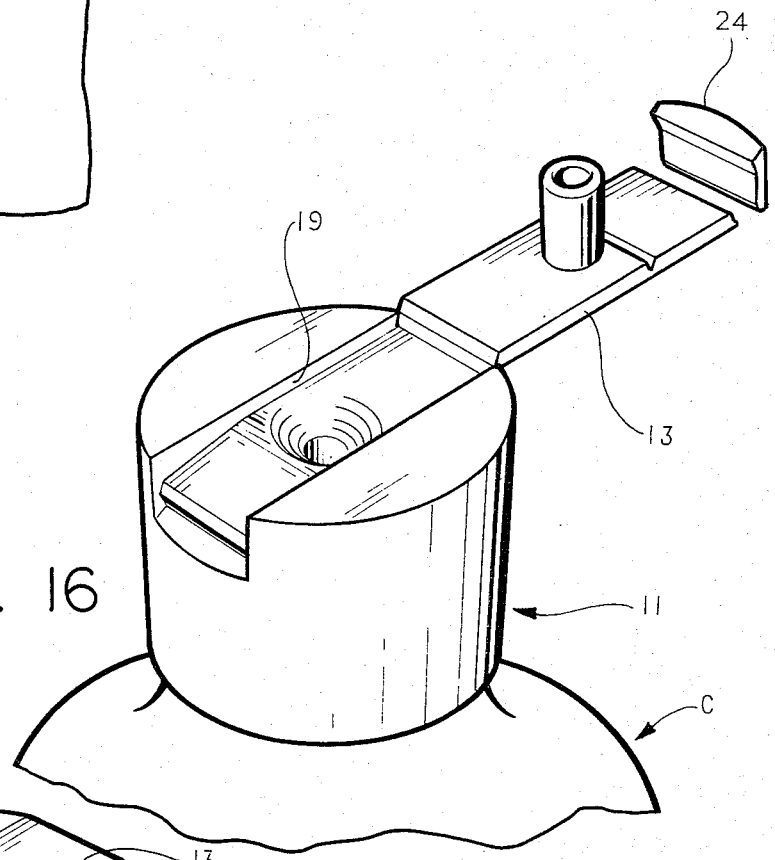
FIG. 16
FIG. 17
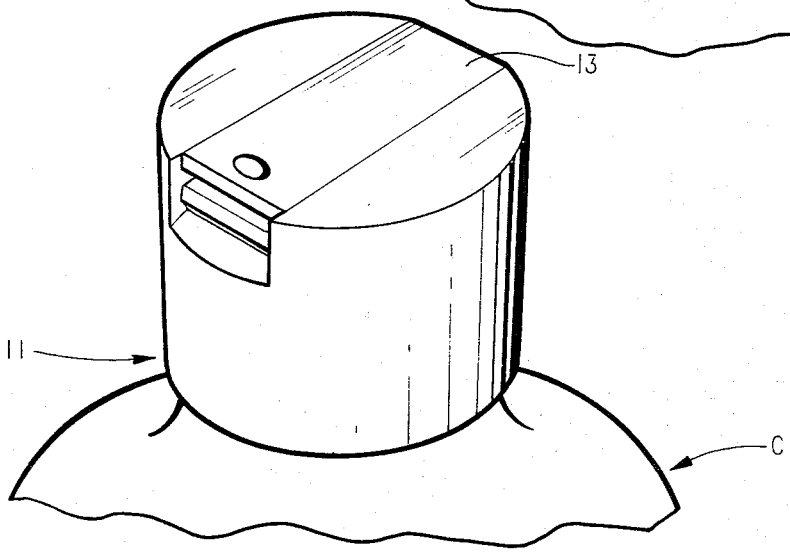

ONE-PIECE THERMOPLASTIC CHILD-RESISTENT DISPENSING CLOSURE

BACKGROUND OF THE INVENTION

This invention relates to a dispensing closure, i.e., a closure which permits the removal of the contents of the associated container through the closure without the removal of the closure. More particularly, this invention relates to a dispensing closure of the child-resistent or safety type in that, once properly applied to the associated container, it cannot be readily opened or removed from the container by children to permit the accidental spillage or ingestion of the contents of the container, while at the same time being capable of being opened by an adult without undue difficulty.

Prior U.S. Pat. Re. No. 29,793 (Pehr) and my prior U.S. Pat. Nos. 4,209,100 and 4,220,262 describe one-piece molded thermoplastic safety or child-resistent dispensing closures, and each such closure comprises a body member and an integrally attached locking flap which is foldable with respect to the body member and which snugly fits within a recess of the body member when it is in the closing position with respect to a dispensing opening in the body member. Each of such closures of my aforesaid U.S. Patents is child-resistent in that the body member of the closure comprises serrations to engage corresponding serrations of the associated container in the manner of a ratchet, after proper application thereto, to mechanically interfere with the removal of the closure from the container, and in that each is provided with structure which requires special manipulation to permit the removal of the locking flap from the recess of the body member to permit the removal of the contents of the container, or a portion thereof, through the body member. In the closure of U.S. Pat. No. 4,209,100 the special manipulation of the closure to permit the opening of the locking flap involves an initial squeezing of the opposite sides of the body member, and in the closure of U.S. Pat. No. 4,220,262 the special manipulation involves an initial step of applying a downward force on the central portion of the top of the closure, and in each of the closures the initial step is followed by a prying action against a portion of the locking flap which becomes exposed by the initial step. The closure of U.S. Pat. Re. No. 29793 also requires a prying action to disengage the locking flap from its closed position.

One of the problems with the closures described above is that the prying action referred to above involves the application of significant levels of prying force against surfaces which are exposed to a very limited extent by the initial step in the opening manipulation, and as a result the opening of these closures can on occasion lead to the breakage of fingernails. Another problem with each of these closures is that the child-resistent feature of the locking flap thereof cannot be readily circumvented or eliminated, which may be desirable in households which are not inhabited or regularly visited by young children, especially in households inhabited by one or more occupants with impaired hand dexterity due to arthritis or other disease or due to an injury.

SUMMARY OF THE INVENTION

In accordance with the present invention there is provided a one-piece molded thermoplastic child-resistent dispensing closure in which the manipulation of the closure locking flap for the opening thereof involves the application of downward force against or adjacent the free end of the locking flap, where maximum leverage can be obtained, and in which the locking flap has a downwardly depending tab which can, through leverage action, be cammed outwardly for an appreciable distance by a somewhat smaller distance of movement of the locking flap for easier access during opening. One of the features of certain embodiments of the present invention is that the safety or child-resistent feature of the locking flap of the closure can be readily removed, when it is advantageous to do so, by the removal of the depending tab portion of the locking flap by tearing or cutting, and one of the features of certain embodiments of the invention is that the safety or child-resistent feature of the closure can be readily reduced in magnitude or circumvented by the initial manipulation of the locking flap.

For a further understanding of the present invention and the objects thereof, attention is directed to the drawing and the description thereof, to the detailed description of the invention and to the appended claims.

DESCRIPTION OF THE DRAWING

FIG. 16 is a view similar to FIG. 2 depicting a step in the alteration of the closure to change its performance characteristics;

FIG. 17 is a view similar to FIG. 16 showing the altered closure of FIG. 16 in its closed position on the container;

FIG. 18 is an enlarged fragmentary sectional view of the altered closure of FIG. 16 in its closed position on the container.

DETAILED DESCRIPTION OF THE INVENTION

Figure 1:
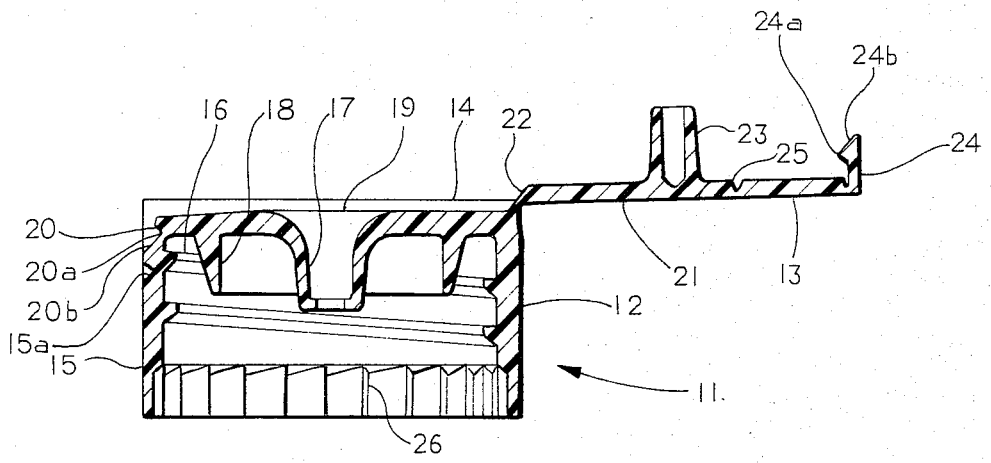
FIG. 1 is an elevational sectional view of a closure in accordance with the present invention.

As is shown in FIG. 1, a closure generally indicated by the reference numeral 11 in accordance with the present invention comprises a body portion 12 and a locking flap 13 which is hingedly connected at one end thereof to body portion 12 at an edge thereof. Body portion 12, in turn, comprises a top panel 14 and an annular skirt 15 which depends from the top panel. Annular skirt 15 is adapted to surround and engage the finish portion of a container to which the closure is to be applied, and this container is generally indicated by reference character C in FIGS. 2–8. Closure 11 is supplied with inwardly extending means, for example a helical thread 16, to engage corresponding means on the container finish to secure the closure 11 to the container C. A closure of this type may be advantageously produced by the injection molding of a suitable thermoplastic material, preferably in the open position depicted in FIG. 1. The material preferably is of a type which will permit the user to open and close the closure many times, and of the known thermoplastic materials, polypropylene and high density polyethylene can meet these requirements in a cost effective manner.

The top panel 14 of closure 11 is provided with dispensing opening means in the form of a depending tubular portion 17 which depends from the underside of the top panel. Tubular portion 17 is open to the contents of container C to permit the removal of such contents, or any desired portion thereof, through the closure 11 without the need to remove closure 11 from container C. Also depending from the underside of the top panel 14 of closure 11 is an annular flange 18 which is adapted to snugly conform to the inside of the finish of container C, as is shown, for example, in FIG. 4, to help seal the closure 11 to container C.

As previously noted, closure 11 also comprises a locking flap 13 which is hingedly connected at one end thereof to said body portion along a line or hinge, as shown by reference numeral 22. Locking flap 13 is movable about hinge 22 with respect to body portion 12 from the position depicted in FIGS. 1 and 2, which is the open or dispensing position of the closure, to the closed position as is depicted, for example, in FIGS. 3 and 4. The top panel 14 of the body portion is provided with a recess 19 for receiving the locking flap 13 when it is in its closed position, and recess 19 is of a size and shape so that locking flap 13 fits snugly therein, with the top surface of locking flap 13 flush with the unrecessed top surface of top panel 14, to make it difficult for a child to grasp locking flap 13 at any location between its ends when it is in its closed position and to thereby help to prevent the accidental spillage or ingestion of the contents of container C. Locking flap 13 is also provided with a blocked tubular projection 23 which depends downwardly from the underside of the locking flap when it is in the closed position. Tubular projection 23 is of a size, shape and position to fit snugly within tubular portion 17 of top panel 14 when locking flap 13 is in its closed position, as is depicted, for example, in FIG. 4, and this relationship between tubular projection 23 and tubular portion 17 serves to help keep locking flap 13 secure in its closed position while sealing the inside of the dispensing opening of the closure.

Figure 3:
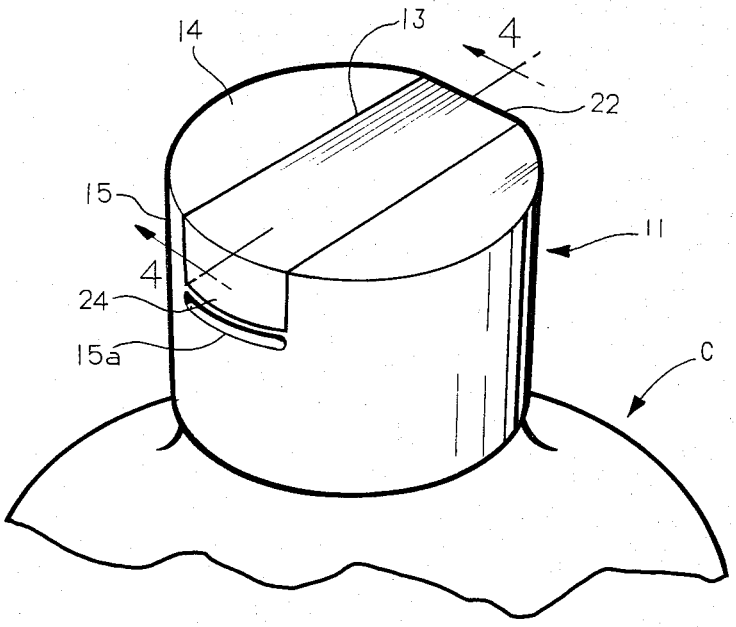
FIG. 3 is a fragmentary perspective view depicting the closure of FIG. 1 in its closed position on a container.
Figure 4:
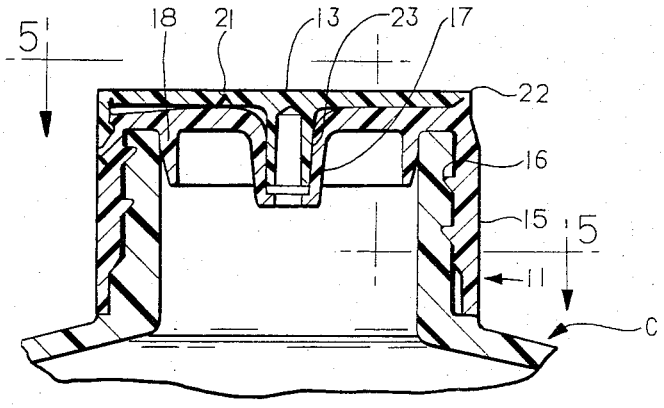
FIG. 4 is a sectional view taken on line 4—4 of FIG. 3.

As is clearly illustrated in FIGS. 1 and 3, for example, locking flap 13 comprises a tab 24 which depends downwardly from its free end when the locking flap is in its closed position, and the annular skirt 15 of the body portion 12 of the closure comprises a recess 20 which comprises a downwardly projecting extension of recess 19 in the top panel 14 of the body portion. Recess 20 is of a size and shape so that the tab portion 24 of locking flap 13 will fit snugly therein when the locking flap is in its closed position, again to make it difficult for a child to find an exposed portion of the free end of the locking tab to permit accidental or inadvertant opening thereof. To further enhance the locking of locking flap 13 in its closed position, a snap fit between locking flap 13 and body portion 12 may be obtained by providing the tab 24 of the locking flap with an inwardly projecting bead 24*a* and by providing recess 20 with an inwardly projecting groove 20*a* which receives bead 24*a* when the locking flap is moved to the closed position.

Figure 2:
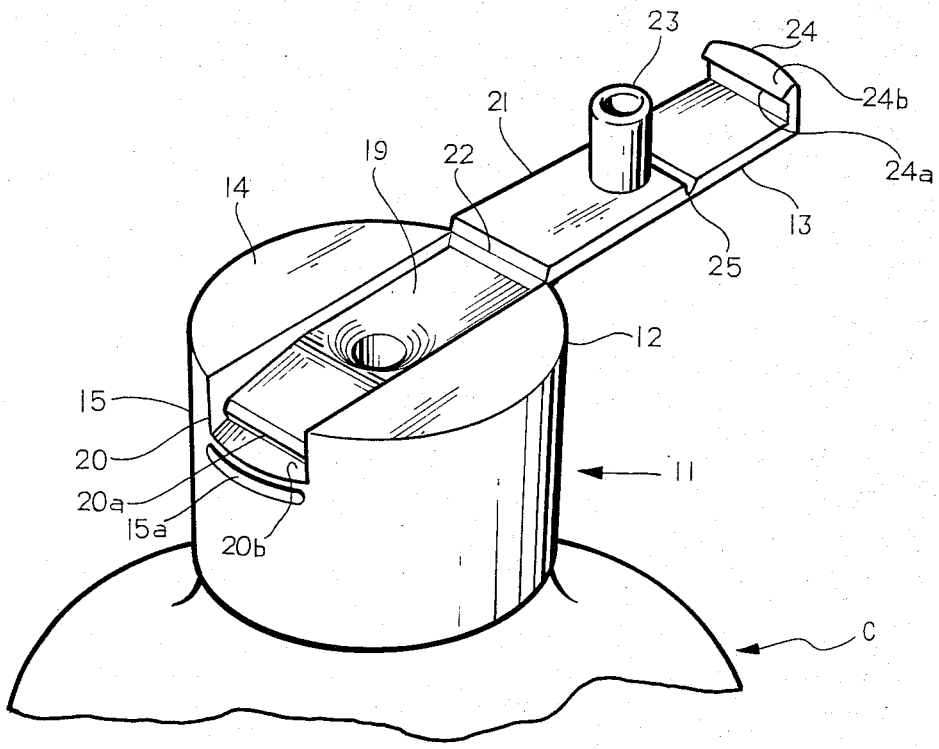
FIG. 2 is a fragmentary perspective view depicting the closure of FIG. 1 in its opened dispensing position on a container.
Figure 6:
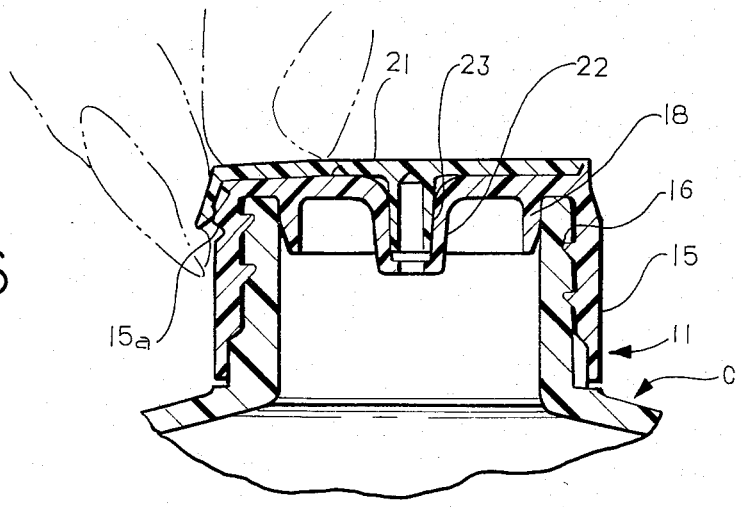
FIG. 6 is a view similar to FIG. 4 which depicts a step in the opening of the closure.
Figure 7:
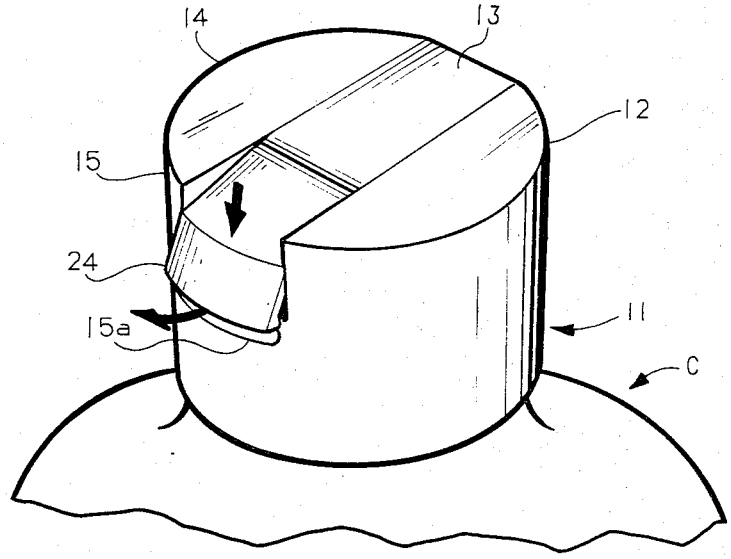
FIG. 7 is a perspective view depicting the closure of FIG. 6 during the opening process.
Figure 8:
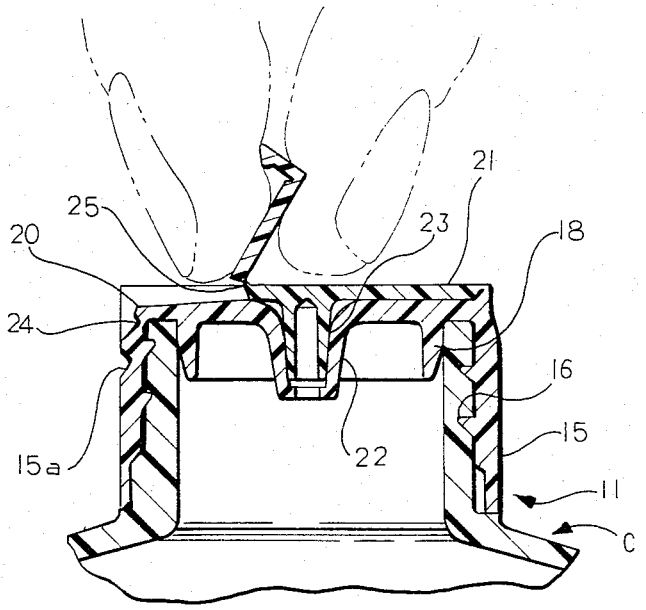
FIG. 8 is a view similar to FIG. 6 which depicts a later step in the opening of the closure.
Figure 10:
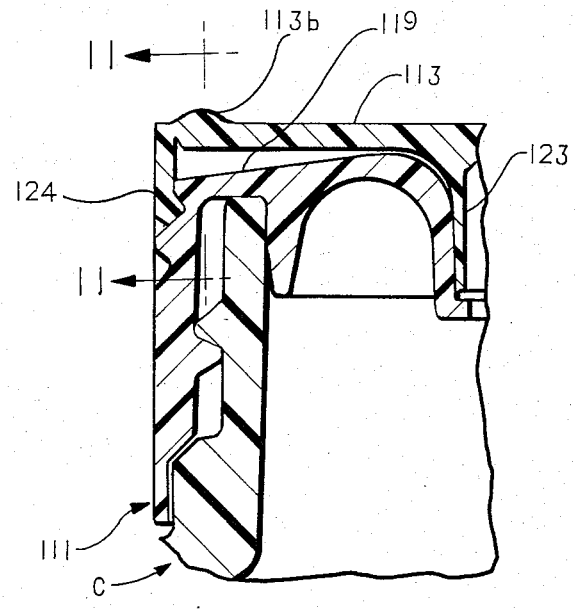
FIG. 10 is an enlarged fragmentary sectional view of the closure of FIG. 9 in its closed position on the container.
Figure 11:
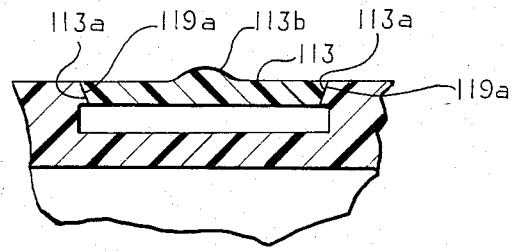
FIG. 11 is a sectional view taken on line 11—11 of FIG. 10.
Figure 9:
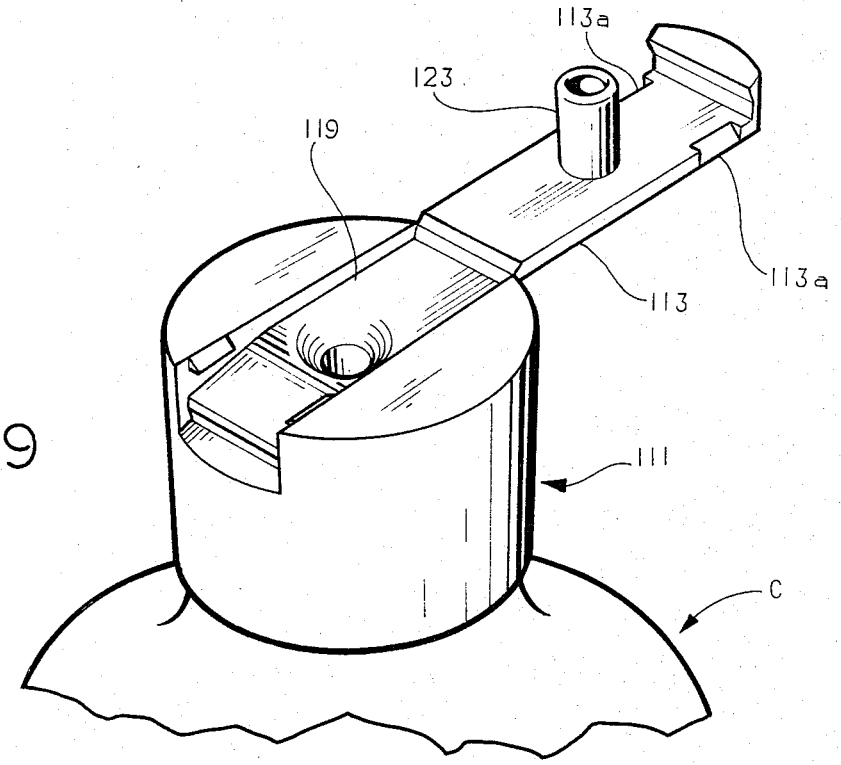
FIG. 9 is a perspective view of a modified embodiment of a closure in an opened condition on a container.

To facilitate the opening of the locking flap 13 the depth of recess 19 is somewhat greater than the thickness of the locking flap 13 at a location adjacent the free end of the locking flap. Preferably, recess 19 has a maximum depth at the juncture of recess 19 and recess 20, and tapers inwardly and upwardly therefrom to a depth which is substantially equal to the thickness of the corresponding portion of the locking flap at a location adjacent to tubular portion 17 on the side thereof which faces the free end of the locking flap. This added depth in recess 19 adjacent the free end of locking flap 13 makes it possible to manually depress the free end within the recess, as is shown in FIGS. 6 and 7, and this action makes it possible to grasp the tab 24 which depends from the locking flap to begin the opening process. The added depth in recess 19 adjacent the free end of locking flap will not be occupied by the free end of the locking flap until downward pressure is applied thereto because of the fact that the closure is molded in the opened position, as is shown in FIG. 2, and will, as a consequence thereof, have a small upwardly directed bending stress therein when it is in the closed position.

To help make sure that tab 24 is made available for grasping by the depression of the free end of locking flap 13 as heretofore described, the bottom of tab 24 is provided with an upwardly and inwardly inclined surface 24*b* which engages an upwardly and inwardly inclined surface 20*b* in recess 20 in surface to surface contact when locking flap 13 is in its normal closed position. Thus, the depression of the free end of locking flap 13 in recess 19 has the effect of driving the bottom of tab 24 radially outwardly as well as downwardly through the cam action of surface 24*b* on surface 20*b* for easy access for grasping by the user who intends to open the package. This access can be further enhanced by providing closure skirt 15 with an outwardly facing groove 15*a* located just below the bottom of tab 24 in recess 20.

To facilitate the lifting of locking flap 13 after the grasping of tab 24, as heretofore described, the underside of locking flap 13 may be provided with a groove 25 extending thereacross at a location between tubular projection 23 and tab 24. This groove will serve as a hinge to permit the free end of locking flap 13 to be bent with respect to the other portion of the locking flap so that the action tending to remove projection 23 from tubular dispensing opening 17 will be more nearly parallel to the axes of such members, for maximum effect of the removal force.

Figure 5:
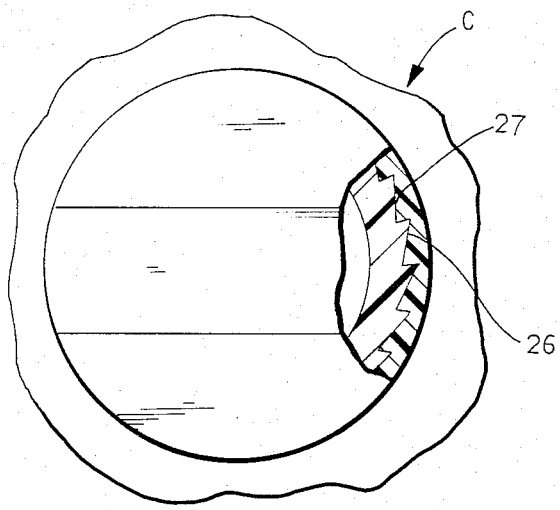
FIG. 5 is a sectional view taken on line 5—5 of FIG. 4.

To provide maximum resistence to accidental removal of closure 11 from container C, the inside of closure skirt 15 is provided with a circumferential series of inwardly projecting ratchet teeth 26 which engage a corresponding circumferential series of outwardly projecting ratchet teeth 27 on the finish of container C, as is seen, for example, in FIG. 5. By virtue of the use of such series of ratchet teeth, which are inclined in the direction of the application of closure 11 on the finish of container C, considerably more torque is required to remove the closure than to apply it, and this inhibits accidental removal of the closure by a child or otherwise. Such resistence to accidental removal of the closure can also be obtained without the illustrated ratchet teeth by bonding or adhering the closure to the container by the use of a suitable adhesive or by ultrasonically or heat sealing it thereto, in a known manner.

Figure 12:
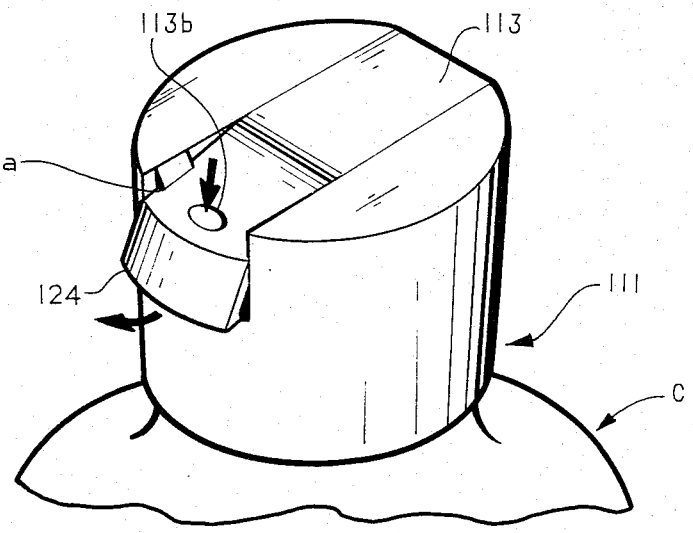
FIG. 12 is a perspective view of the closure of FIG. 9 in a closed position on a container after the initial manipulation of the closure to facilitate opening.
Figure 13:
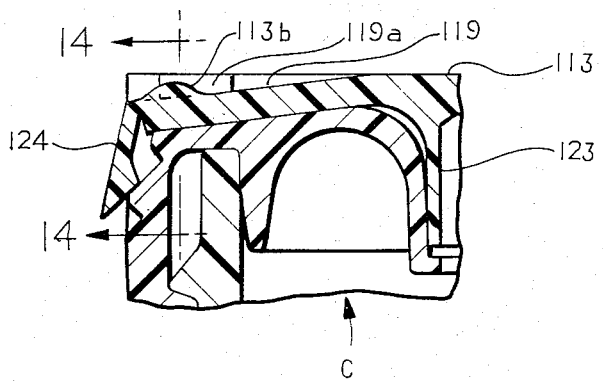
FIG. 13 is an enlarged fragmentary sectional view of the closure of FIG. 12 in the position illustrated therein.
Figure 14:
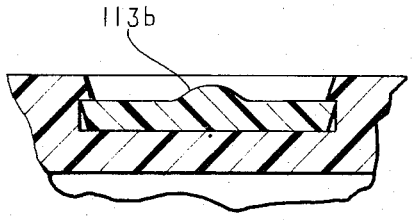
FIG. 14 is a sectional view taken on line 14—14 of FIG. 13.
Figure 15:
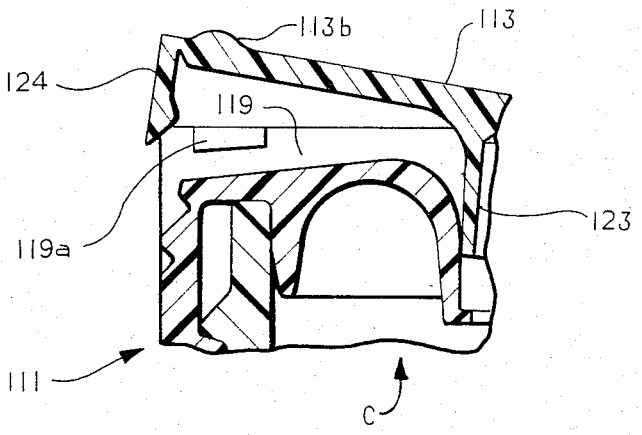
FIG. 15 is a view similar to FIG. 13 in which the closure is depicted at a stage during the opening thereof.
Figure 19:
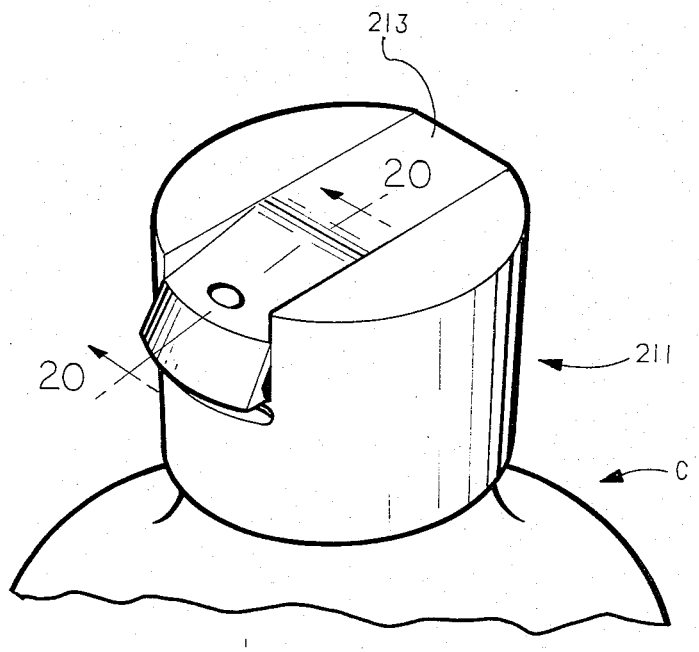
FIG. 19 is a perspective view of another embodiment of a closure in accordance with the present invention in its position on a container.
Figure 20:
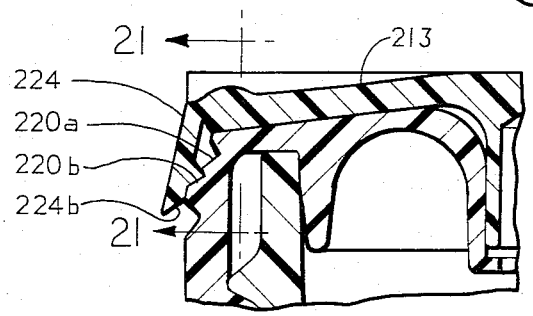
FIG. 20 is a sectional view, at an enlarged scale, taken on line 20—20 of FIG. 19.
Figure 21:
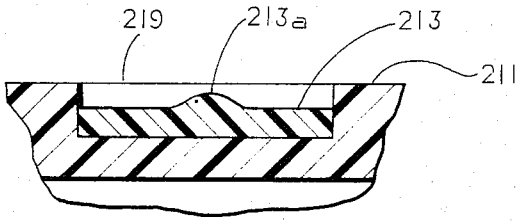
FIG. 21 is a sectional view taken on line 21—21 of FIG. 20.
Figure 22:
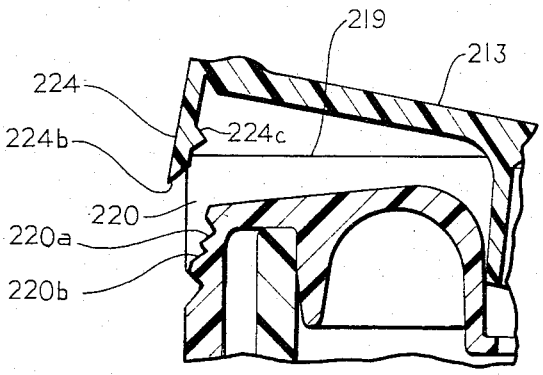
FIG. 22 is a view similar to FIG. 20 showing the closure at a later stage during the opening thereof.
Figure 23:
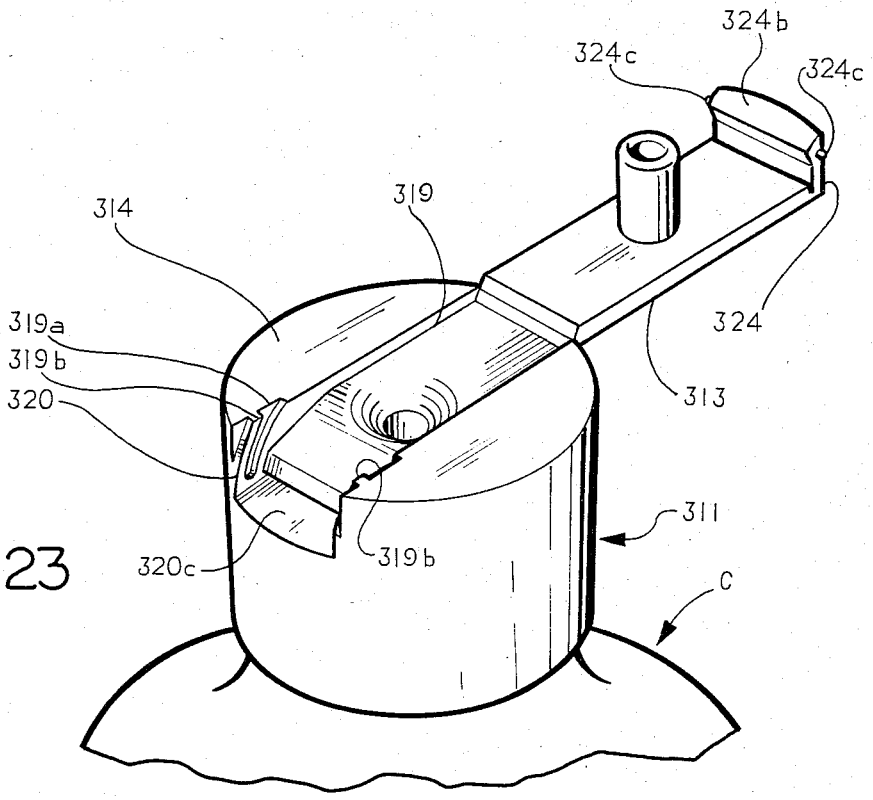
FIG. 23 is a perspective view of another embodiment of a closure in accordance with the present invention in its opened or dispensing position on a container.
Figure 24:
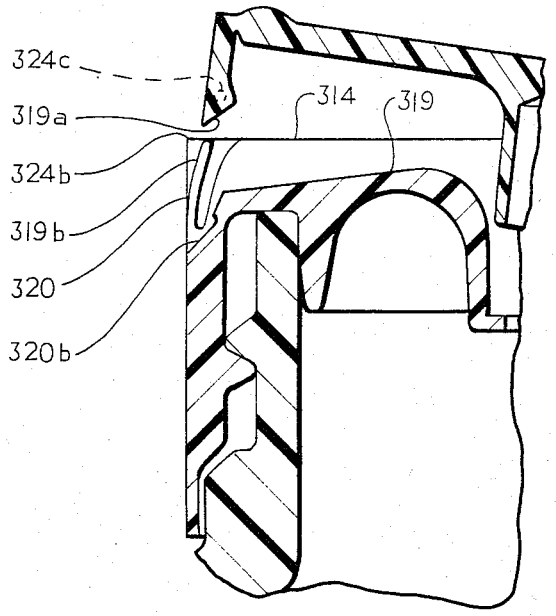
FIG. 24 is a sectional view, at an enlarged scale, of the closure of FIG. 23 in a partially closed position.
Figure 27:
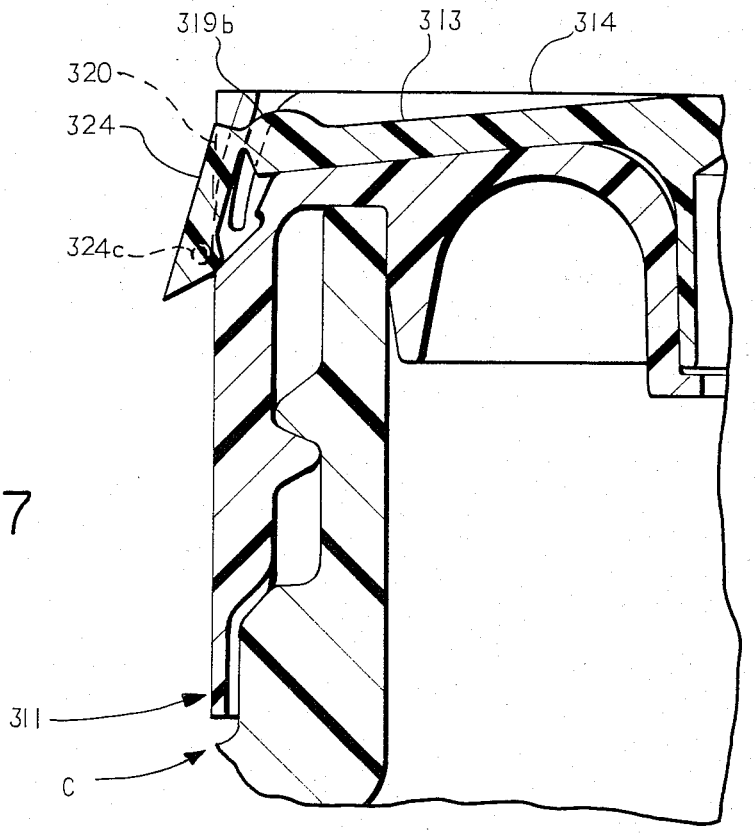
FIG. 27 is a view similar to FIG. 24, at an enlarged scale, in which the closure is shown in an intermediate position during an opening attempt.
Figure 25:
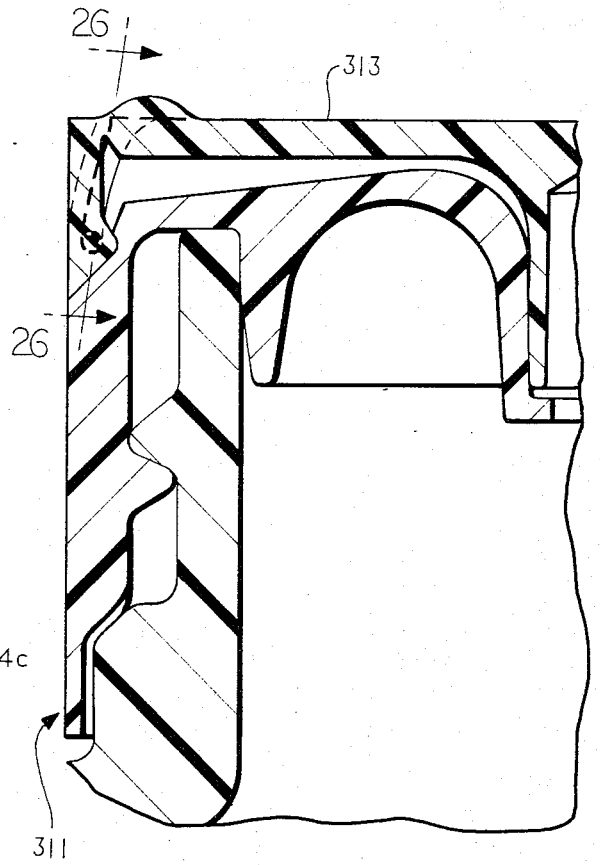
FIG. 25 is a view similar to FIG. 24 in which the closure is illustrated in its closed position.
Figure 26:
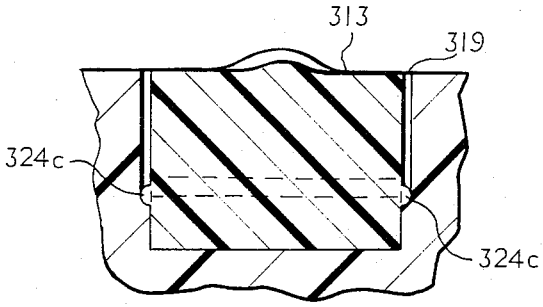
FIG. 26 is a sectional view taken on line 26—26 of FIG. 25.

In the embodiment of the invention which is depicted in FIGS. 9–15 there is shown a closure 111 in assembled relationship with a container C. Like closure 11 of the embodiment of FIGS. 1–8, closure 111 may be formed by injection molding a suitable thermoplastic material, e.g., polypropylene or high density polyethylene. One of the features of closure 111 is that its locking flap 113 is provided with a pair of inwardly and downwardly (when the locking flap is in its closed position) inclined surfaces 113*a* on the opposite sides thereof between its free end and its tubular projection 123, and the recess 119 of such closure embodiment is provided with inwardly and downwardly inclined projections 119*a* which engage surfaces 113*a* in surface to surface contact when the locking tab 113 is in its closed position. Thus, as is shown in FIGS. 12–14, when the free end of locking flap 113 is depressed downwardly in recess 119 it will snap under and be retained by projections 119*a*, and its depending tab 124 will remain in a readily accessible position to be grasped for opening without the need to maintain the downward force on the locking tab as is required to open the closure of FIGS. 1–8. This will facilitate opening of the closure by adults who suffer from impaired hand function due to arthritis or other disease or due to the effects of a hand injury. Locking flap 113 is also provided with an upwardly projecting rounded button 113*b* near its free end to facilitate the depressing of the locking flap into recess 119. Locking flap 113 is not shown as comprising a groove corresponding to groove 25 of the embodiment of FIGS. 1–8, but of course such a groove may be provided if desired.

FIGS. 16–18 illustrate a technique for eliminating the child-resistent feature of the locking tab of a dispensing closure in accordance with the present invention, and is depicted in reference to a closure 11 like the closure of the embodiment of FIGS. 1–8 in combination with a container C. As is depicted in FIG. 16 with the locking flap 13 in its opened position, the depending tab 24 of the locking flap has been disengaged from the remainder of the locking flap as by tearing it off or cutting it off. Thus, as is shown in FIGS. 17 and 18, after the closing of the locking flap 13 with the tab 24 removed therefrom, the free end of the locking flap can be readily grasped for opening of the locking flap without the need for special manipulation by depressing the locking flap in the recess 19, and this will permanently add to the convenience of opening the locking flap for adults with impaired hand function. Of course, this feature can also be utilized with closures of the type illustrated in FIGS. 9–15, or with other embodiments of this invention.

FIGS. 19–22 illustrate an embodiment of the invention in which a closure 211 is shown in assembled relationship with a container C. Like closure 111 of the embodiment of FIGS. 9–15, the locking flap 213 of closure 211 will be retained in its downward position after the initial depression of the locking tab so that the push down and pry up motions involved in the opening of the locking flap need not be performed simultaneously, a feature of advantage to adults with impaired hand dexterity. In the case of closure 211 the retention of the depressed locking tab is accomplished by an inward projection 224*c* in the tab 224 of the locking flap, at a location somewhat above the upwardly and inwardly inclined cam surface 224*b*, and a groove 220*b* in recess 220 which receives the tab 224 when the locking flap is in its normal closed position. Groove 220*b* is located below upwardly and inwardly inclined cam surface 220*a* in recess 220, and projection 224*c* snaps into groove 220*b* upon the depression of locking flap 213 to move tab 224 outwardly by the sliding action of surface 224*a* along surface 220*a*. Closure 211 may also be formed by injection molding a suitable thermoplastic material.

Closure 211 is also shown as comprising an upwardly projecting button 213*a* at the free end of locking flap 213 to facilitate the depression of the locking flap. This feature can, of course, be utilized on the other embodiments of the closure of the present invention, where desired.

FIGS. 23–27 illustrate an embodiment of the invention in which a closure 311 is shown in assembled relationship with a container C. The unique feature of closure 311 relative to closures 11, 111 and 211 is that its locking flap, which is identified by reference numeral 313, can be opened simply by pushing down on its free end, without the need for a prying action to effect its initial upward movement, either simultaneously with or subsequent to the pushing down action. This feature is obtained by providing the tab portion 324 of locking flap 313 with an outwardly extending projection 324*c* on each of its sides and by providing the locking flap receiving recess 319 in the top panel 314 of closure 311 with an enlarged portion 319*a* adjacent the free end of the locking flap to permit projections 324*c* to pass therethrough. Additionally, an arcuate track for the movement of projections 324*c* through recess 319*a* is obtained by providing recess 319*a* with ribs 319*b* which project inwardly from the sides of recess 319*a* inwardly.

Ribs 319*b*, which are shown as being curved to be compatible with the curvilinear movement of projection 324*c* in recess 319*a*, stop short of the bottom of recess 319 so that the projections can pass thereunder when the locking flap is depressed from its locked position at the time it is desired to open the locking flap. Thus, when the locking flap is depressed, the tab portion 324 will be cammed outwardly by the sliding action of its cammed surface 324*b* along surface 320*b* of the closure, and projections 324*c* will pass under ribs 319*b* and be moved radially outwardly with respect to ribs 319*b*. Closure 311 is also preferably formed by injection molding in the open position. When the closure 311 is so formed, release of the depressing force on locking flap 313, due to the natural residual upward biasing force therein as a result of having been molded in the opened position, will cause the locking flap to rise on its own, since the projections 324*c* now engage the radially outside surfaces of ribs 319*b* and this inhibits the tab portion 324 from returning to the position where it will lock in its receiving recess 320.

The best mode known to me to carry out this invention has been described above in terms sufficiently full, clear, concise and exact as to enable any person skilled in the art to make and use the same. It is to be understood, however, that it is within my contemplation that certain modifications of the abovedescribed mode of practicing the invention can be made by a skilled artisan without departing from the scope of the invention and it is, therefore, desired to limit the invention only in accordance with the appended claims.

What is claimed is:

1. In a one-piece dispensing closure for a container with a closure receiving finish, which closure comprises; a body portion with a top panel and dispensing opening means in said top panel, an annular skirt depending from said top panel and adapted to surround the finish portion of said container, means extending inwardly from the annular skirt for engaging said finish to secure the closure to the container, and a locking flap hingedly connected to said body portion and comprising sealing means for sealingly engaging the dispensing opening means when the locking flap is in a closed position, said locking flap being foldable between said closed position and an open position to permit the dispensing of the contents of the container through the dispensing opening means when said locking flap is in said open position, said top panel containing a recess for receiving the locking flap when said locking flap is in the closed position, the improvement in which said recess is deeper than the thickness of the locking flap at the end of the locking flap away from the location of the hinged attachment of the locking flap to the body portion to permit said end of the locking flap to be depressed within said recess to expose said end for access to facilitate the movement of the locking flap to the opened position.

2. A closure according to claim 1 wherein the locking flap comprises a tab which depends downwardly from said end thereof when the locking flap is in the closed position and in which the annular skirt comprises a recess which receives the tab when the locking flap is in the closed position, the tab being deflected outwardly by the depression of the locking flap within the recess of the top panel.

3. A closure according to claim 1 wherein said locking flap is provided with a region of reduced thickness extending thereacross between said sealing means and the free end of the locking flap to permit the free end to be depressed downwardly into the recess in the top panel with respect to the sealing means and to be lifted upwardly with respect to the sealing means during the movement of the locking flap to the closed position.

4. A closure according to claim 2 and further comprising an additional recess in the annular skirt below the recess which receives the tab of the locking flap for better access to the free end of the tab to facilitate the movement of the locking flap from the closed position to the open position.

5. A closure according to claim 2 wherein the recess in the top panel which receives the locking flap comprises means therein to retain said end of the locking flap in said depressed condition.

6. A closure according to claim 5 wherein the free end of the tab comprises a surface which inclines inwardly and upwardly from the exterior thereof and wherein the recess in the annular skirt comprises an inclined surface which engages said surface of the tab in surface to surface engagement when the locking flap is in its closed position, whereby the depression of the locking flap within the recess of the top panel will cause the free end of the tab to be cammed outwardly by virtue of said surface to surface engagement.

7. A closure according to claim 6 wherein the tab comprises a projection which extends outwardly from a side thereof and wherein the recess comprises a rib which extends inwardly from a side thereof, the rib being positioned so that the projection is on the inside thereof when the locking flap is in the locked position, the depression of the locking flap and the outward camming of the free end of the tab which results therefrom causing the projection to pass under the rib so that the projection is on the outside of the rib to permit the locking flap to rise freely upon the removal of the depressing force.

8. A closure according to claim 7 wherein the tab comprises a second projection which extends outwardly from the other side thereof and wherein the recess comprises a second rib which extends inwardly from the other side thereof, the second rib being positioned so that the second projection is on the inside thereof when the locking flap is in the closed position, the depression of the locking flap and the outward camming of the free end of the tab which results therefrom causing the second projection to pass under the second rib so that the second projection is on the outside of the second rib when the said projection is on the outside of the said rib.

9. A closure according to claims 1, 2, 3, 4, 5, 6, 7 or 8 which is formed by injection molding from a material selected from the group consisting of high density polyethylene and polypropylene.

10. A closure according to claim 9 in which the closure is molded with the locking flap in its open position whereby there will be an upwardly directed residual stress in the locking flap when it is in its closed position.

11. The combination of a container having a closure receiving finish, a product packaged in said container and a closure according to claims 1, 2, 3, 4, 5, 6, 7 or 8 attached to said closure receiving finish.

12. The combination according to claim 11 in which the closure receiving finish of the container comprises a circumferential series of ratchet teeth which are inclined in the direction of the application of the closure on the finish and in which the means extending inwardly from the annular skirt of the closure comprises a circumferential series of ratchet teeth in engagement with the ratchet teeth on the finish, the torque required for removal of the closure from the finish being considerably higher than the torque required to apply the closure to the finish to inhibit removal of the closure from the finish by a child.

13. The combination according to claim 11 in which the closure is formed by injection molding from a material selected from the group consisting of high density polyethylene and polypropylene.

14. The combination according to claim 13, in which the closure is molded with the locking flap in the open position whereby there will be an upwardly directed residual stress in the locking flap when it is in its closed position.

* * * * *